US011767999B2

(12) United States Patent
McCune et al.

(10) Patent No.: US 11,767,999 B2
(45) Date of Patent: Sep. 26, 2023

(54) SYSTEM AND METHOD FOR MONITORING CHARGE LEVEL OF HVAC SYSTEM

(71) Applicant: Johnson Controls Technology Company, Auburn Hills, MI (US)

(72) Inventors: Tyler P. McCune, El Dorado, KS (US); Shawn A. Hern, Derby, KS (US); Aneek M. Noor, Wichita, KS (US); Cody J. Kaiser, Wichita, KS (US); Drew H. Carlton, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 862 days.

(21) Appl. No.: 16/681,576

(22) Filed: Nov. 12, 2019

(65) Prior Publication Data

US 2021/0140661 A1 May 13, 2021

(51) Int. Cl.
*F24F 11/32* (2018.01)
*F24F 11/63* (2018.01)

(52) U.S. Cl.
CPC ..... *F24F 11/32* (2018.01); *F24F 11/63* (2018.01)

(58) Field of Classification Search
CPC ..... F24F 11/32; F24F 11/63; F24F 2140/12; F24F 2140/20
See application file for complete search history.

(56) References Cited

U.S. PATENT DOCUMENTS

| | | | | |
|---|---|---|---|---|
| 5,987,903 | A * | 11/1999 | Bathla | B60H 1/00978 62/126 |
| 9,638,436 | B2 | 5/2017 | Arensmeier et al. | |
| 9,765,979 | B2 | 9/2017 | Alsaleem et al. | |
| 10,060,636 | B2 | 8/2018 | Alsaleem et al. | |
| 2006/0042276 | A1* | 3/2006 | Doll | F25B 49/005 62/201 |
| 2006/0137364 | A1* | 6/2006 | Braun | F25B 49/005 62/149 |
| 2013/0160470 | A1* | 6/2013 | Schuster | F25B 45/00 62/77 |
| 2015/0135748 | A1* | 5/2015 | Alsaleem | F25B 49/005 165/11.1 |
| 2019/0252151 | A1* | 8/2019 | Kato | H01J 37/20 |
| 2020/0003467 | A1* | 1/2020 | Noor | F25B 41/22 |

* cited by examiner

*Primary Examiner* — Andrew Schechter
*Assistant Examiner* — Jeremy A Delozier
(74) *Attorney, Agent, or Firm* — Fletcher Yoder, P.C.

(57) ABSTRACT

A heating, ventilation, and/or air conditioning (HVAC) system includes a sensor configured to detect an operating parameter of the HVAC system, a processor, and a memory having instructions executable by the processor to cause the processor, during a normal operation mode of the HVAC system, to iteratively receive feedback from the sensor indicative of a value of the operating parameter, compare the value with reference data, and determine a refrigerant charge level of the HVAC system based on the value and the reference data.

22 Claims, 8 Drawing Sheets

SYSTEM AND METHOD FOR MONITORING CHARGE LEVEL OF HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the amount of refrigerant in the vapor compression circuit may not be desirable. For example, there may be an insufficient amount of refrigerant or there may be an excessive amount of refrigerant circulating in the vapor compression circuit. An undesirable amount of refrigerant may affect a performance of the HVAC system, such as by reducing an efficiency of the HVAC system to condition the supply air flow.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a sensor configured to detect an operating parameter of the HVAC system, a processor, and a memory having instructions executable by the processor to cause the processor, during a normal operation mode of the HVAC system, to iteratively receive feedback from the sensor indicative of a value of the operating parameter, compare the value with reference data, and determine a refrigerant charge level of the HVAC system based on the value and the reference data.

In another embodiment, a non-transitory computer readable storage medium for a heating, ventilation, and/or air conditioning (HVAC) system includes instructions that, when executed by a processor, are configured to cause the processor, during a normal operation mode of the HVAC system, to receive an input indicative of an operating parameter value of the HVAC system from a sensor of the HVAC system, correlate the operating parameter value to reference data determined in testing of the HVAC system, and determine a refrigerant charge level of the HVAC system based on correlation of the operating parameter value and the reference data.

In another embodiment, a heating, ventilation, and/or air conditioning (HVAC) system includes a plurality of sensors, in which each sensor of the plurality of sensors is configured to detect a respective operating parameter of a plurality of operating parameters of the HVAC system. The HVAC system further includes a controller configured to, during a normal operation mode of the HVAC system, iteratively receive feedback from the plurality of sensors, in which the feedback includes a respective value associated with each operating parameter of the plurality of operating parameters of the HVAC system, compare each value with respective reference data, and determine a current refrigerant charge level of the HVAC system based on comparison of each value with the respective reference data.

DRAWINGS

Various aspects of this disclosure may be better understood upon reading the following detailed description and upon reference to the drawings in which.

DETAILED DESCRIPTION

Figure 1:
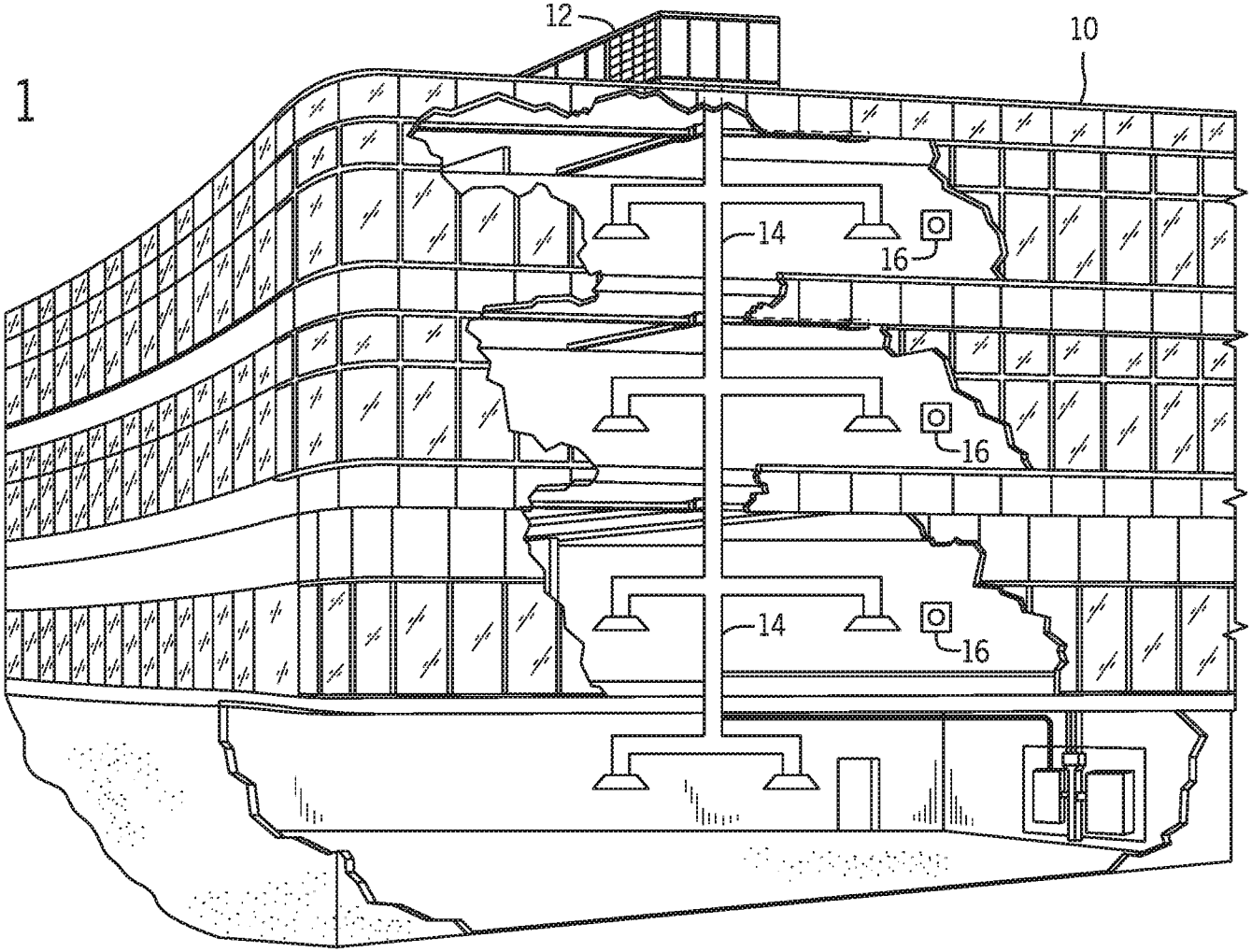
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system having a refrigerant circuit with refrigerant circulating therethrough. The HVAC system may include a compressor positioned along the refrigerant circuit and configured to pressurize the refrigerant. The compressor may direct the pressurized refrigerant to a condenser positioned along the refrigerant circuit and configured to cool the refrigerant, and the compressor may receive refrigerant from an evaporator positioned along the refrigerant and configured to place the refrigerant in a heat exchange relationship with an air flow conditioned by the refrigerant.

The amount of refrigerant in the HVAC system, or the refrigerant charge level of the HVAC system, may change over time. For example, refrigerant may escape from piping or components of the HVAC system, thereby reducing the amount of refrigerant circulating in the refrigerant circuit. An undesirable refrigerant charge may impact a performance of the HVAC system, such as reducing an efficiency of the HVAC system. Furthermore, it may be difficult to directly measure an amount of refrigerant circulating in the refrigerant circuit. As an example, it may be difficult to accurately determine a volumetric amount of refrigerant in the refrigerant circuit and whether the volumetric amount of refrigerant is within a range that enables the HVAC system to operate desirably.

Thus, it is presently recognized that a system and method for determining the refrigerant charge level of the HVAC system may also determine whether the HVAC system is operating as desired. Accordingly, embodiments of the present disclosure are configured to monitor values of other operating parameters of the HVAC system to determine the refrigerant charge level of the HVAC system. For example, the values of one of the operating parameters may be compared with a respective reference data or expected values of the operating parameter. As used herein, compare may refer to a comparison between a value of an operating parameter and a value of a single reference data point, a comparison between a value of an operating parameter and a range of reference data points, a correlation between a value of the operating parameter and a model, algorithm, or equation of the reference data, or any combination thereof. If the value of the operating parameter deviates from the reference data by a threshold amount, the refrigerant charge level of the HVAC system may be undesirable. The operating parameters may be constantly monitored while the HVAC system is in operation to condition the air flow. Thus, the refrigerant charge level may be monitored without having to operate the HVAC system in a different operating mode and without affecting the operation of the HVAC system during conditioning of the air flow. In some embodiments, the HVAC system may use a machine learning scheme to determine and/or monitor the refrigerant charge level. The machine learning scheme may change the respective reference data of the various operating parameters based on the operational conditions of the HVAC system, such that the reference data better reflects and/or is better tailored to the particular HVAC system. In this way, the machine learning scheme enables the refrigerant charge level of the HVAC system to be more accurately determined and monitored based on the implementation of the HVAC system, such as the specification of various components of the HVAC system and/or a specific environment of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
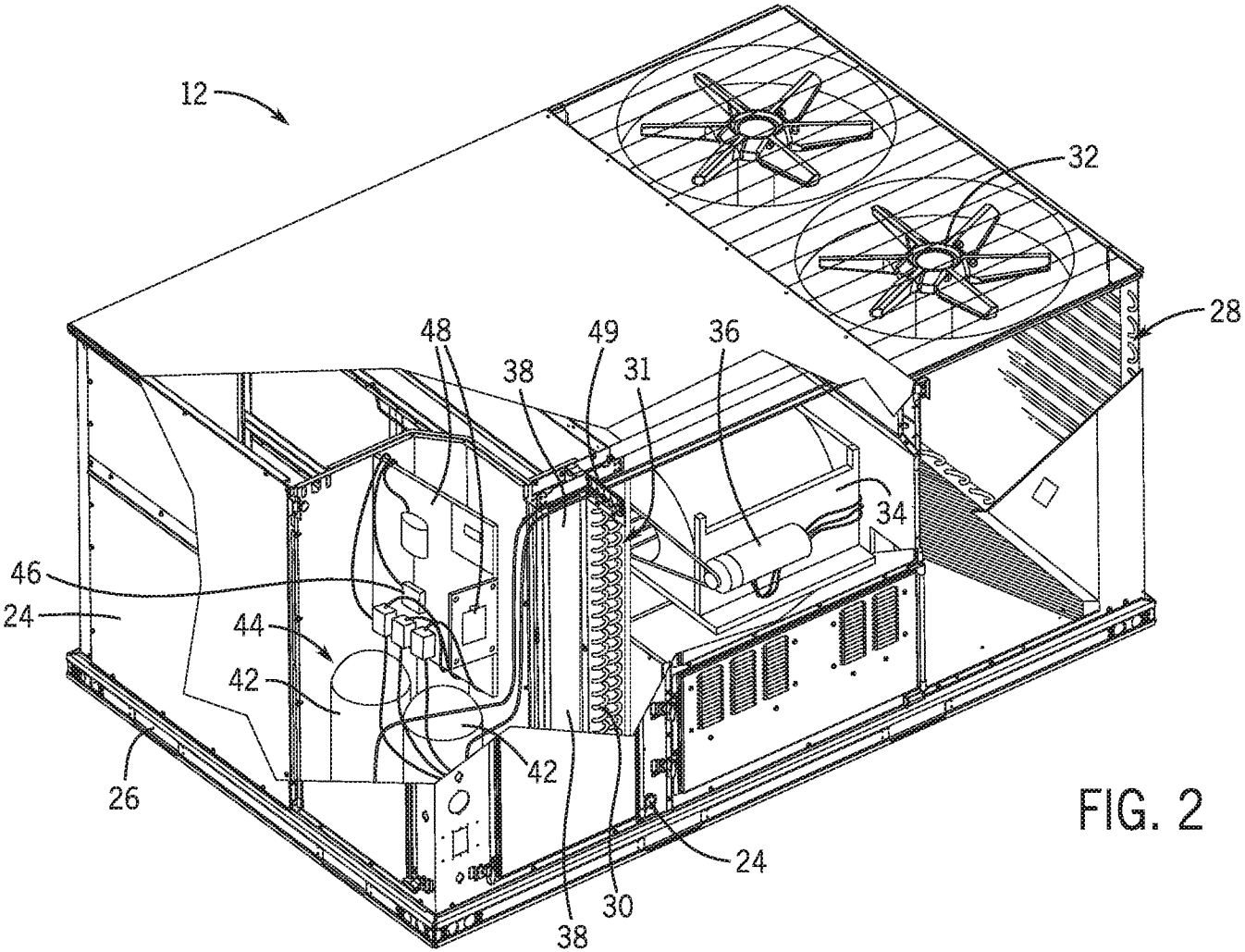
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
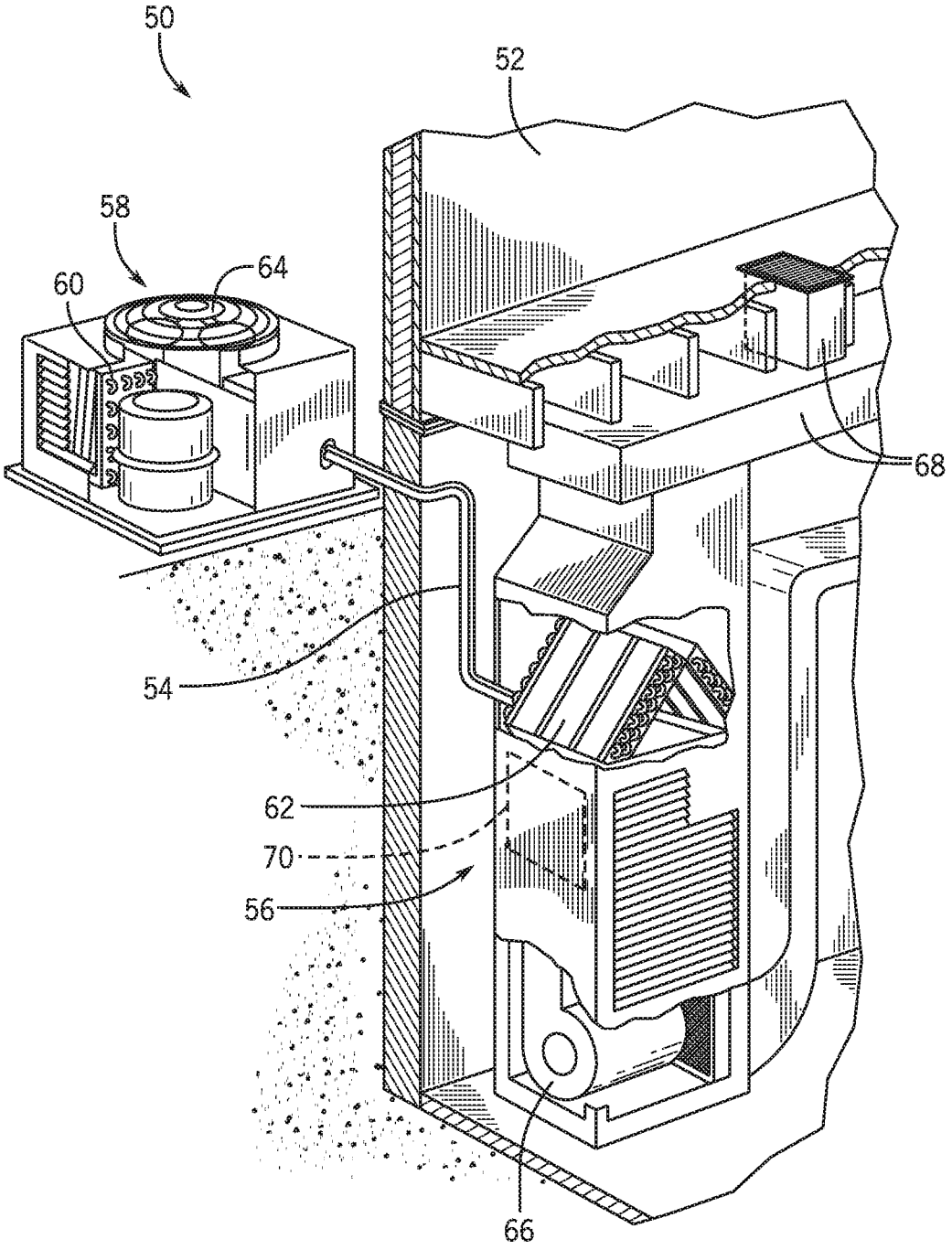
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
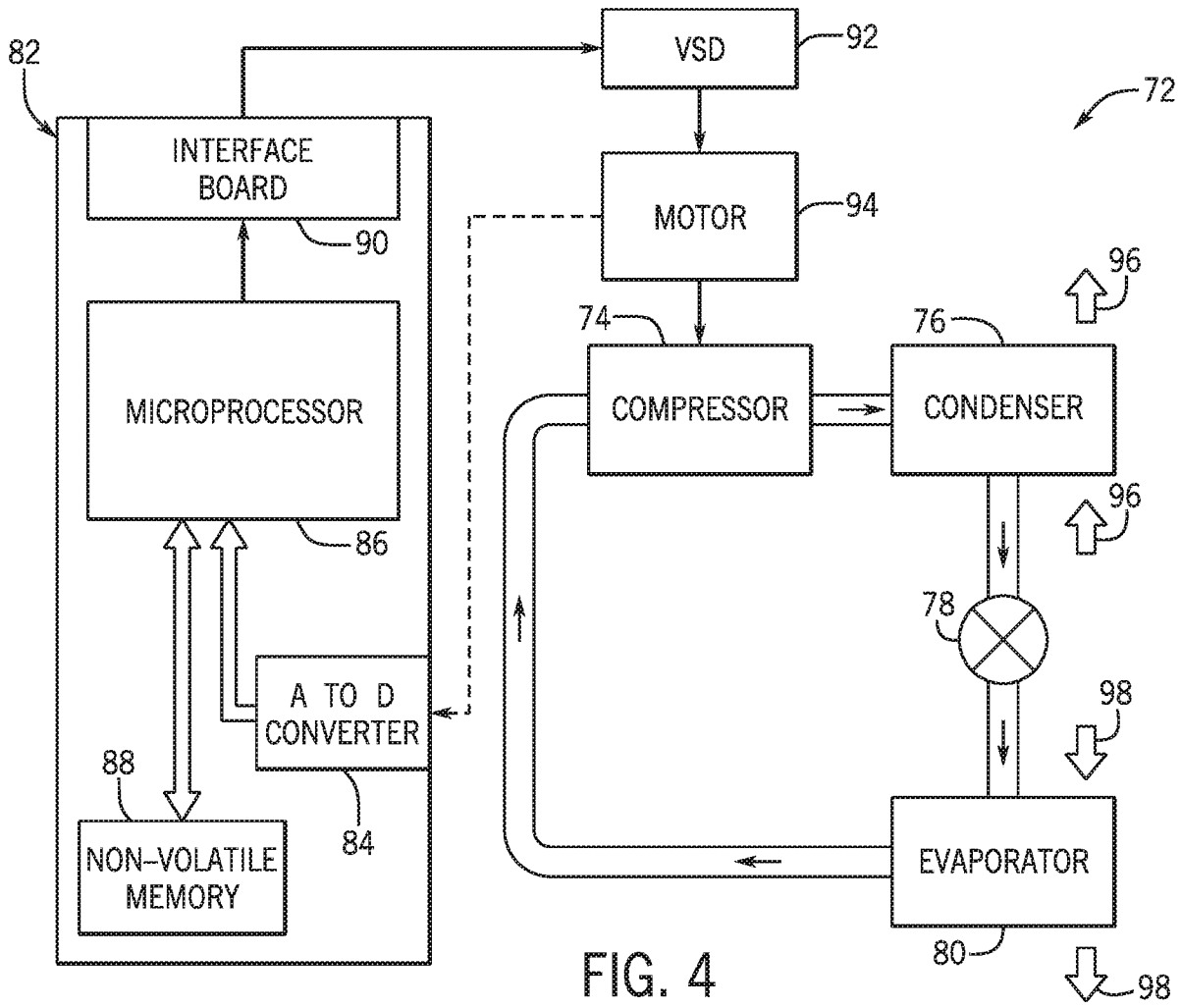
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system configured to monitor a refrigerant charge level. The HVAC system may monitor various operating parameters to determine whether the refrigerant charge level is within a desirable range. For instance, during normal operation or a normal operation mode, or any operational mode of the HVAC system that conditions the air flow, the HVAC system may continuously or iteratively compare or correlate a determined value of each operating parameter with respective reference data, such as a respective reference data point. The refrigerant charge level may be determined based on the amount that the operating parameter deviates from the reference data point. For example, the value of one of the operating parameters deviating from the corresponding reference data point by a first amount may indicate that the refrigerant charge level is below a desirable range. As a result, the HVAC system may be flagged to indicate that the HVAC system is undercharged and that additional refrigerant is to be added to the HVAC system. Additionally, the value of the operating parameter deviating from the corresponding reference data point by a second amount the refrigerant charge level may indicate that the refrigerant charge level is above the desirable range. In response, the HVAC system may be flagged to indicate that the HVAC system is overcharged and that refrigerant is to be removed from the HVAC system. In this manner, the refrigerant charge level of the HVAC system is determined based on corresponding operating parameter values associated with the normal operation mode of the HVAC system. Although the present disclosure discusses comparison with a single reference data point, the operating parameter values may additionally or alternatively be correlated with other reference data, such as a range of reference data values, a reference data algorithm or model, or any other suitable reference data.

Furthermore, the HVAC system may use a machine learning scheme to determine and/or monitor the refrigerant charge level more accurately. For example, the machine learning scheme may be used to set and/or adjust the respective reference data points of the various operating parameters. The specific, respective reference data points of the HVAC system in its particular implementation may be different than default reference data points that are initially implemented for comparison. Thus, the default reference data points may be changed during normal operation mode of the HVAC system to reflect the particular operating conditions of the HVAC system. As such, the machine learning scheme may establish more accurate reference data points to which the various operating parameters may be compared for determining the refrigerant charge level more accurately.

Figure 5:
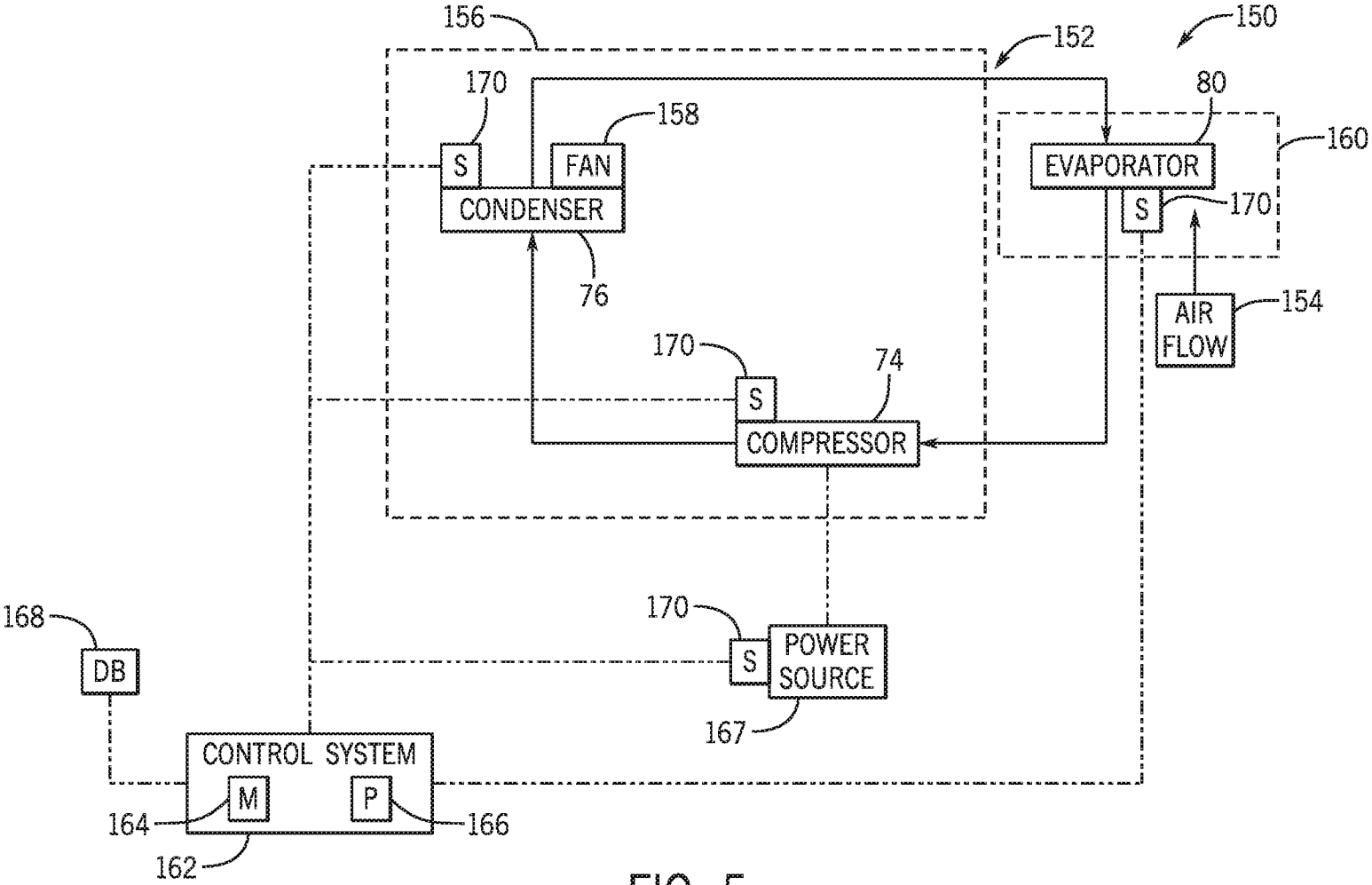
FIG. 5 is a schematic view of an embodiment of an HVAC system having a controller configured to determine a refrigerant charge level of the HVAC system, in accordance with an aspect of the present disclosure.

FIG. 5 is a schematic view of an embodiment of an HVAC system 150 having a refrigerant circuit 152 through which refrigerant is directed. The HVAC system 150 may have the compressor 74 positioned along the refrigerant circuit 152 and configured to pressurize the refrigerant. The HVAC system 150 may further include the condenser 76 positioned along the refrigerant circuit 152 and configured to cool the refrigerant received from the compressor 74, as well as the evaporator 80 positioned along the refrigerant circuit 152 and configured to place the refrigerant in a heat exchange relationship with an air flow 154 to condition the air flow 154. In the illustrated embodiment, the compressor 74 and the condenser 76 may each be positioned within an ambient environment 156, such as an outdoor environment, and the condenser 76 may include a fan 158 configured to draw or force ambient air across a condenser coil through which the refrigerant flows, thereby removing heat from the refrigerant via convection. Furthermore, the evaporator 80 may be positioned within an indoor environment 160, such as an interior of a structure serviced by the HVAC system 150, and may condition the air flow 154 for supply to the structure, thereby conditioning the structure. Thus, the HVAC system 150 may be a split system, such as the residential heating and cooling system 50. In additional or alternative embodiments, the compressor 74, the condenser 76, and the evaporator 80 may each be positioned within the same environment. For example, the HVAC system 150 may be an RTU, such as the HVAC unit 12. In further embodiments, the HVAC system 150 may be a heat pump, and the functionality of the condenser 76 and the evaporator 80 may switch based on the operating mode of the HVAC system 150.

In any case, the HVAC system 150 may include a control system 162 configured to operate the HVAC system 150. The control system 162 may have a memory 164 and a processor 166. The memory 164 may include volatile memory, such as random-access memory (RAM), and/or non-volatile memory, such as read-only memory (ROM), optical drives, hard disc drives, solid-state drives, or any other non-transitory computer-readable medium that includes instructions to operate the HVAC system 150. The processor 166 may be configured to execute such instructions, such as to operate the HVAC system 150 in a normal operation mode. By way of example, the control system 162 may be communicatively coupled to a power source 167 that is electrically coupled to the compressor 74. The control system 162 may regulate a supply of power provided to the compressor 74 to operate the compressor 74 at a particular operating level in order to pressurize the refrigerant a particular amount in the normal operation mode. The processor 166 may include one or more application specific integrated circuits (ASICs), one or more field programmable gate arrays (FPGAs), one or more general purpose processors, or any combination thereof. In some embodiments, the control system 162 may be a physical, onboard controller, such as the control panel 82 or a thermostat that may be operable by a user. Additionally or alternatively, the control system 162 may be a remote control system, such as a part of a cloud-based or cloud-computing system that is communicatively coupled to the HVAC system 150. In such embodiments, the memory 164 and the processor 166 are components of the cloud-based system, and the processor 166 may receive sensor feedback transmitted from another component, such as a thermostat or other physical controller of the HVAC system 150, for determining the refrigerant charge level.

Additionally or alternatively, the control system 162 may be configured to monitor a refrigerant charge level of the HVAC system 150. In some embodiments, the control system 162 may monitor the value of various operating parameters of the HVAC system 150 to determine the refrigerant charge level. For instance, the control system 162 may also be communicatively coupled to one or more databases 168, such as a server, a cloud database, and/or any other suitable database, that may include information used by the control system 162 for determining the refrigerant charge level of the HVAC system 150 based on the values of the operating parameters. By way of example, the database(s) 168 may include database tables, algorithms, models, other suitable information, or any combination thereof, that may be referenced by the control system 162 for determining the refrigerant charge level of the HVAC system 150 using the values of the operating parameters. As used herein, the refrigerant charge level may refer to a total volume of refrigerant circulating the refrigerant circuit 152.

In certain embodiments, the HVAC system 150 may include several sensors 170 that are each communicatively coupled to the control system 162. Each sensor 170 may be configured to monitor a particular operating parameter. For example, the operating parameters may include a flow rate at which the air flow 154 is directed through the HVAC system 150, a temperature of the indoor environment 160, a humidity of the indoor environment 160, a temperature of the ambient environment 156, a discharge pressure and/or temperature of the compressor 74, a suction pressure and/or temperature of the compressor 74, a liquid pressure and/or temperature of the refrigerant, an evaporating pressure and/or temperature of the refrigerant in the evaporator 80 and/or the condenser 76, a power consumption of the compressor 74, a rotational speed of a motor of the compressor 74, a rotational speed of the fan 158, another suitable operating parameter, or any combination thereof. The control system 162 may receive the respective values of the operating parameters monitored by the sensors 170 and determine the refrigerant charge level of the HVAC system 150 based on the respective values.

Figure 6:
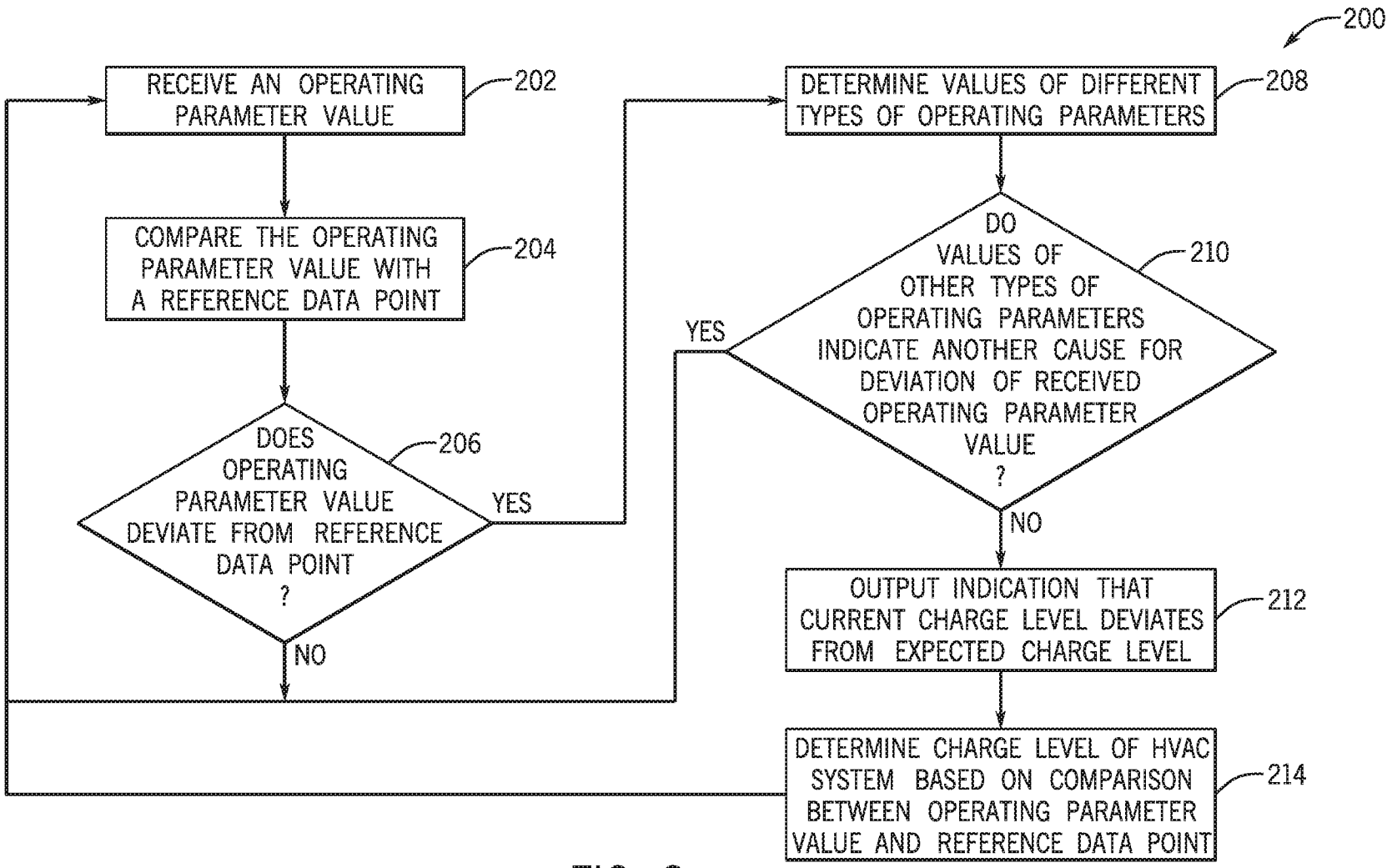
FIG. 6 is a flowchart of an embodiment of a method or process for determining the refrigerant charge level of an HVAC system based on an operating parameter, in accordance with an aspect of the present disclosure.
Figure 7:
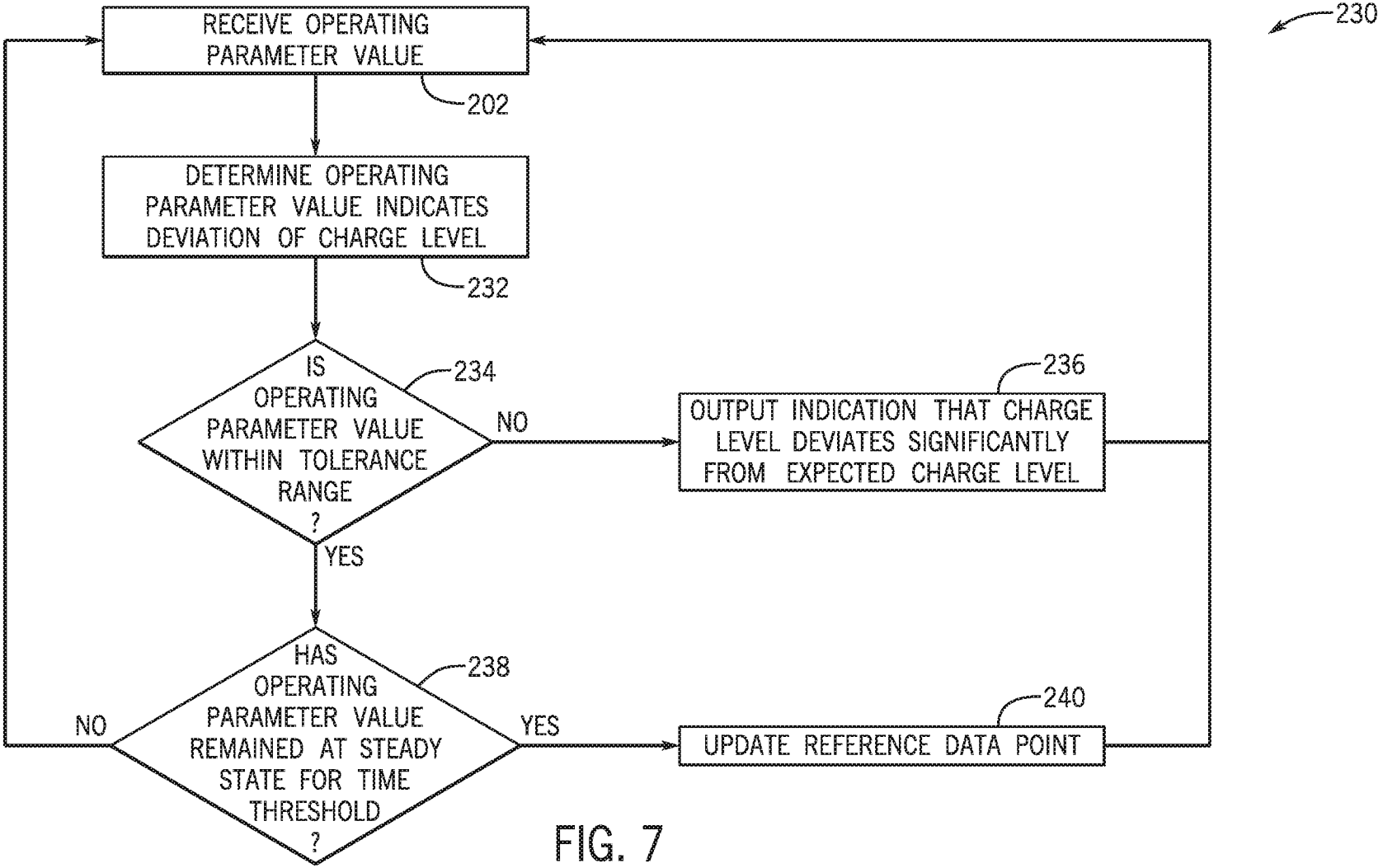
FIG. 7 is a flowchart of an embodiment of a method or process for changing a reference data point for monitoring a refrigerant charge level of an HVAC system, in accordance with an aspect of the present disclosure.

FIGS. 6 and 7 each illustrate an embodiment of a method or process for operating the HVAC system 150 based on a particular operating parameter value, which may be received from one of the sensors 170. Each depicted method or process may be performed by a controller, such as by the control system 162. It should be noted that the steps of each method or process may be performed differently, such as for different embodiments of the HVAC system 150. By way of example, additional steps may be performed with respect to the steps depicted in FIGS. 6 and 7. Additionally or alternatively, certain steps described in FIGS. 6 and 7 may be removed, modified, performed in a different order, and/or performed simultaneously with one another. Further, each method or process may be performed during the normal operation mode of the HVAC system 150, or any operation of the HVAC system 150 to condition the air flow 154, rather than an operating mode that is separate or different from the normal operation mode, in which the air flow 154 is not conditioned by the HVAC system 150.

FIG. 6 is a flowchart of an embodiment of a method or process 200 for determining the refrigerant charge level of the HVAC system 150 based on an operating parameter detected during the normal operation mode of the HVAC system 150. At block 202, an operating parameter value is received, such as from one of the sensors 170. The operating parameter value may be associated with any of the operating parameters described above as pertaining to the HVAC system 150 or any other suitable operating parameter of the HVAC system 150. At block 204, the operating parameter value is compared or correlated with a reference data point, which is reflective or indicative of an expected value of the operating parameter during the normal operation mode. For instance, the reference data point may be retrieved from the database(s) 168. In some embodiments, the reference data point may be based on a particular operating mode of the HVAC system 150 during the normal operation mode. As an example, the reference data point may be a first value when the HVAC system 150 is operating to condition the air flow 154 to a first temperature, and the reference data point may be a second value when the HVAC system 150 is operating to condition the air flow 154 to a second temperature. As such, the reference data point retrieved from the database(s) 168 corresponds to the reference data point that is associated with the relevant operation of the HVAC system 150.

At block 206, a determination is made regarding deviation of the operating parameter value from the reference data point. If the operating parameter value does not deviate from the reference data point, the refrigerant charge level may be at an expected or acceptable level. Thus, no further actions may be performed with the received operating parameter value, and the step at block 202 may be repeated to receive additional values of the operating parameter. However, if it is determined that the operating parameter value does deviate from the reference data point, values of other types of operating parameters may be determined, as indicated at block 208. In other words, values of various other operating parameters may be received from other sensors 170 and analyzed.

At block 210, a determination is made regarding whether the values of the other types of operating parameters indicate that there is another cause for the deviation of the received operating parameter value from the reference data point. In some embodiments, information from the database(s) 168 may be retrieved to determine whether the values of the other types of operating parameters indicate that the received operating parameter value deviates from the reference data point because of a deviation in the refrigerant charge level. To this end, the information from the database (s) 168 may include, at a particularly received operating parameter value, values or range of values of the other operating parameters that indicate a particular cause of deviation of the received operating parameter value. For example, at the received operating parameter value, a first value, such as a high value, of another type of operating parameter may indicate that the received operating parameter value deviates due to the refrigerant charge level. However, a second value, such as a low value, of the other type of operating parameter may indicate that the received operating parameter value deviates due to a faulty operation of another component of the HVAC system 150, such as of the expansion valve or device 78. Such information regarding the other types of operating parameters may be established or determined based on a previous operation of the HVAC system 150. For instance, during maintenance of the HVAC system 150 at a previous time, an operator or technician may determine that operation of the expansion valve or device 78 is faulty. In response, the database(s) 168 may store values of the operating parameters that were received during operation of the HVAC system 150 causing the maintenance to be performed on the HVAC system 150. Such values of the operating parameters may then be attributed to faulty operation of the expansion valve or device 78 and may be referred to in subsequent operations of the HVAC system 150 so as to determine whether deviation of the received operating parameter value is caused by operation of the expansion valve or device 78 or by any other relevant cause, such as the refrigerant charge level.

If it is determined that the deviation of the received operating parameter value from the reference data point is not caused by a deviation of the refrigerant charge level, no further action may be performed regarding the received operating parameter, and the step at block 202 may be repeated to receive another value of the operating parameter. However, if it is determined that the deviation of the received operating parameter value is caused by the refrigerant charge level based on the values of other types of operating parameters, an indication may be output to indicate that the current refrigerant charge level deviates from an expected charge level, as shown at block 212. The indication may include a notification sent to a user, such as an operator, a technician, and/or a customer of the HVAC system 150, so that the user is aware that the current refrigerant charge level deviates from the expected refrigerant charge level. As such, the user may request or perform maintenance on the HVAC system 150 and/or may continue to monitor the refrigerant charge level of the HVAC system 150. In some embodiments, the indication may be output when the deviation between the operating parameter value and the reference data point exceeds a threshold value. Thus, the indication may not be output when the deviation between the operating parameter value and the reference data point is insignificant so as to avoid outputting the indication when the current refrigerant charge level only slightly deviates from the expected refrigerant charge level.

At block 214, the refrigerant charge level of the HVAC system 150 is determined based on the comparison between the operating parameter value and the reference data point as performed at block 204. In some embodiments, the refrigerant charge level may be based on the amount of deviation between the operating parameter value and the reference data point. For instance, a large deviation between the operating parameter value and the reference data point may indicate the refrigerant charge level deviates from the expected refrigerant charge level by a greater amount. As an example, the HVAC system 150 may be 50 percent undercharged. However, a small deviation between the operating parameter value and the reference data point may indicate the refrigerant charge level deviates from the expected refrigerant charge level by a smaller amount. As another example, the HVAC system 150 may be 10 percent undercharged. Moreover, a different deviation between the operating parameter value and the reference data point may indicate the refrigerant charge level deviates from the expected refrigerant charge level in a different manner. As a further example, the HVAC system 150 may be 10 percent undercharged when the operating parameter value is less than the reference data point by a threshold amount, and the HVAC system 150 may be 10 percent overcharged when the operating parameter value is greater than the reference data point by another threshold amount.

In some embodiments, after the step at block 214 has been performed, the method 200 may be repeated. That is, the value of the operating parameter may be received after the refrigerant charge level of the HVAC system 150 has been determined. Thus, the operating parameter value may be iteratively received, and the refrigerant charge level of the HVAC system 150 may be continually determined. In this way, the method 200 may be performed for multiple iterations so as to determine whether the refrigerant charge level is changing over time.

FIG. 7 is a flowchart of an embodiment of a method or process 230 for changing a reference data point based on receiving an operating parameter value during the normal operation mode of the HVAC system 150. In other words, the method or process 230 may be representative of a machine learning scheme for the HVAC system 150. The method 230 initiates with receiving the operating parameter value, as discussed above with reference to block 202. That is, the operating parameter value may be received from one of the sensors 170. At block 232, the operating parameter value is determined to indicate a deviation between the current refrigerant charge level and the expected refrigerant charge level. For example, the method 200 may be performed to determine that the operating parameter value deviates from the reference data point as a result of the refrigerant charge level.

At block 234, a determination is made regarding whether the operating parameter value is within a tolerance range. The tolerance range may be established during development and/or testing of the HVAC system 150 and may generally be indicative of acceptable values of the operating parameter value to indicate that the refrigerant charge level does not substantially deviate from the expected refrigerant charge level. If the received operating parameter value is outside of the tolerance range, another indication may be output, as shown at block 236, to indicate the refrigerant charge level deviates significantly from the expected refrigerant charge level. Such an indication may be similar to the indication output at block 212 and may notify a user to perform maintenance on the HVAC system 150 and/or to continue to monitor the refrigerant charge levels of the HVAC system 150. After the indication is output, the step at block 202 may be repeated to receive another operating parameter value, and no changes to the reference data point are made. In additional or alternative embodiments, operation of the HVAC system 150 may be suspended or shut down, such as when the refrigerant charge level significantly impacts an operation of the HVAC system 150.

However, if the operating parameter value is determined to be within the tolerance range, a determination may be made regarding whether the operating parameter value has remained at a steady state for a time threshold, as indicated at block 238. As used herein, a value at steady state refers to a generally constant value. In other words, as the operating parameter value is received multiple times during multiple iterations of the method 200 and/or the method 230 as the step at block 202 is repeated, it may be determined that the multiple received operating parameter values are substantially within range of a steady state value, such as within 1 percent, 5 percent, or 10 percent, of the same steady state value. The steady state may indicate that the normal operation mode of the HVAC system 150 has stabilized and is not causing substantial fluctuation of the operating parameter value from the steady state value.

If the operating parameter value is determined to not be at steady state for greater than the time threshold, no changes may be made to the reference data point. For instance, the normal operation mode of the HVAC system 150 may not have stabilized, thereby causing the current operating parameter value to deviate significantly from a previously received operating parameter value. Thus, the step at block 202 may be performed to receive another value of the operating parameter value, and the method 230 is repeated.

However, if the operating parameter value is determined to have remained at steady state, or at a steady state value, for greater than the time threshold, the reference data point may be updated, as indicated at block 240. In some embodiments, the reference data point may be updated to the steady state value that is substantially equal to the operating parameter value received at block 202 multiple times for the duration of the time threshold. That is, the received operating parameter value remaining at steady state and within the tolerance range for greater than the time threshold may indicate that the received operating parameter value is the expected operating parameter value during the normal operation mode of the HVAC system 150. As such, the received operating parameter value may also correspond with an expected refrigerant charge level. For this reason, the updated reference data point may be changed to the received operating parameter value to reflect the reference data point value indicative of the expected refrigerant charge level. Thus, subsequently received operating parameter values may be compared to the updated reference data point to determine the refrigerant charge level more accurately with respect to the expected refrigerant charge level. In other words, the reference data point may be adjusted from an initial reference data point and may better reflect the appropriate reference data point pertaining to the particular implementation of the HVAC system 150.

In certain embodiments, the methods 200, 230 may be performed upon each startup of the HVAC system 150 at the beginning of the normal operation mode of the HVAC system 150. For example, during initialization of the HVAC system 150 to condition the air flow 154, the methods 200, 230 may be performed to evaluate the refrigerant charge level of the HVAC system 150. Therefore, the refrigerant charge level of the HVAC system 150 may be determined and/or the reference data point may be updated during startup of the HVAC system 150. Additionally or alternatively, the methods 200, 230 may be performed at a particular frequency during the normal operation mode. By way of example, the methods 200, 230 may be performed once every minute during the normal operation mode, once every five minutes during the normal operation mode, once every ten minutes during the normal operation mode, and so forth. In this way, the refrigerant charge level of the HVAC system 150 may be determined and/or the reference data point may be updated at a particular frequency based on how often the methods 200, 230 are performed.

In some embodiments, the method 230 may be performed concurrently with the method 200. In other words, when the operating parameter value is received, both of the methods 200, 230 may be performed in parallel to one another using the received operating parameter value. In additional or alternative embodiments, the methods 200, 230 may be performed sequentially. By way of example, upon receiving the operating parameter value, the method 200 may be initially performed to determine the refrigerant charge level of the HVAC system 150, and the method 230 may be subsequently performed to determine whether the reference data point is to be changed, or vice versa.

Further, although the methods 200, 230 are depicted as being performed based on a single operating parameter value, in additional or alternative embodiments, FIGS. 6 and 7 may be performed for multiple operating parameter values. For instance, the methods 200, 230, may be performed for various other operating parameter values as described above. Thus, multiple, respective methods 200, 230 may be performed concurrently with one another for each of multiple operating parameter values of the HVAC system 150 to determine the refrigerant charge level of the HVAC system 150 and/or to change the respective reference data points.

Figure 8:
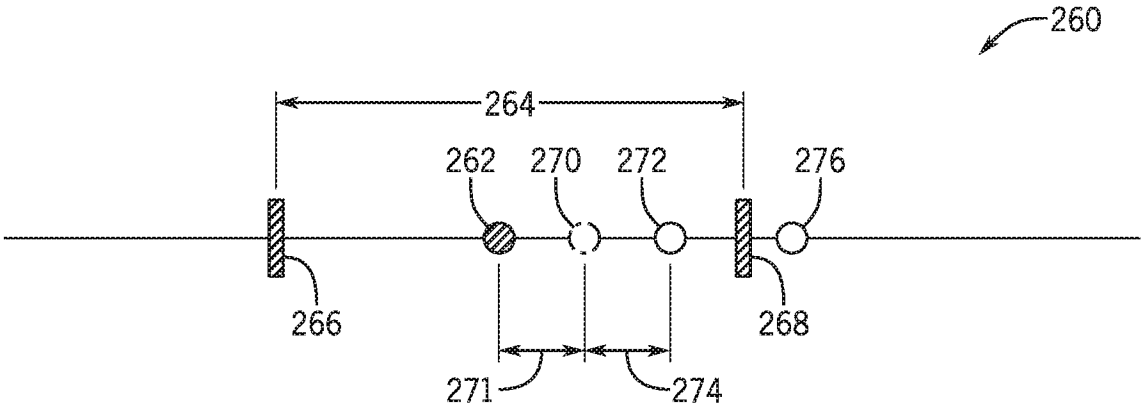
FIG. 8 is a diagram depicting various values of an operating parameter for the HVAC system, in accordance with an aspect of the present disclosure.

FIG. 8 is a diagram 260 depicting various values of an operating parameter for the HVAC system 150. For example, each value of the operating parameter may be received via one of the sensors 170 during the normal operation mode of the HVAC system 150. At a first time of the normal operation mode, a first operating parameter value 262 may be received. The first operating parameter value 262 may substantially match with the reference data point indicative of an expected refrigerant charge level. The reference data point may be an initial reference data point that may originally be set upon installation of the HVAC system 150, such as based on development and/or testing of similar HVAC systems. The matching of the first operating parameter value 262 with the reference data point may indicate that a first refrigerant charge level of the HVAC system 150 is approximately equal to the expected refrigerant charge level and no further action may be taken with regard to the first operating parameter value 262. Furthermore, the first operating parameter value 262 may be within a tolerance range 264 established during development and/or testing of the HVAC system 150. In the illustrated embodiment, the first operating parameter value 262, and therefore the reference data point, may be substantially centered between a low value 266 and a high value 268 of the tolerance range 264, but in alternative embodiments, the reference data point may be offset from the center of the tolerance range 264.

At a second time of the normal operation mode, a second operating parameter value 270 may be received. The second operating parameter value 270 may deviate from the first operating parameter value 262, but may remain within the tolerance range 264. Thus, upon receipt of the second operating parameter value 270, a first indication may be output to indicate that a second refrigerant charge level of the HVAC system 150 deviates from the expected refrigerant charge level at the second time. Further, the deviation between the second operating parameter value 270 and the reference data point may be used to determine the particular refrigerant charge level of the HVAC system 150 at the second time. By way of example, the second operating parameter value 270 may deviate from the first operating parameter value 262 by a first deviation 271, which may be used to determine the second refrigerant charge level of the HVAC system 150.

In some circumstances, the second operating parameter value 270 may be received in consecutive, subsequent iterations of receiving the operating parameter value, such that the second operating parameter value 270 is determined to be at steady state for greater than the time threshold. For instance, deviation of the second operating parameter value 270 from the first operating parameter value 262 may be caused by the specific implementation of the HVAC system 150, rather than by an undesirable refrigerant charge level of the HVAC system 150. Thus, the second operating parameter value 270 may indicate that the initial reference data point, which is approximately the first operating parameter 262, is not reflective of or tailored to the specific implementation of the HVAC system 150. As a result, the reference data point may be updated to be equal to the second operating parameter value 270 instead of to the first operating parameter value 262. It should be noted that, even though the reference data point has been updated to a different value, the tolerance range 264 may not be changed. That is, the low value 266 and the high value 268 may be maintained even when the value of the reference data point changes. In some embodiments, the tolerance range 264 may be changed by an operator and/or a technician, such as upon further testing of the HVAC system 150 to determine whether there is a change in the acceptable values of the operating parameter.

At a third time of the normal operation mode and after the reference data point has been updated to be equal to the second operating parameter value 270, a third operating parameter value 272 may be received. The third operating parameter value 272 may be within the tolerance range 264, but the third operating parameter value 272 may deviate from both the first operating parameter value 262 and the second operating parameter value 270. Since the reference data point was previously updated to be equal to the second operating parameter value 270, a third refrigerant charge level of the HVAC system 150 at the third time is determined based on the deviation between the third operating parameter value 272 and the second operating parameter value 270, rather than the deviation between the third operating parameter value 272 and the first operating parameter value 262.

In an example, the third operating parameter value 272 may deviate from the second operating parameter value 270 by a second deviation 274, which may be indicative of the third refrigerant charge level of the HVAC system 150. In some embodiments, the second deviation 274 may be substantially similar to the first deviation 271. As a result, the second refrigerant charge level, as determined based on the first deviation 271, may be substantially similar to the third refrigerant charge level, as determined based on the second deviation 274, even though the second operating parameter value 270 and the third operating parameter value 272 may be substantially different from one another. In other words, because the reference data point was updated from being equal to the first operating parameter 262 at the second time to being equal to the second operating parameter 270 at the third time, the third refrigerant charge level at the third time may be determined to be substantially the same as the second refrigerant charge level at the second time. In response to receipt of the third operating parameter value 272, another indication may be output to indicate that the third refrigerant charge level of the HVAC system 150 is not at the expected refrigerant charge level based on the deviation between the third operating parameter value 272 and the second operating parameter value 270.

At a fourth time of the normal operation mode and after the reference data point has been updated to be equal to the second operating parameter value 270, a fourth operating parameter value 276 may be received. The fourth operating parameter value 276 may also deviate from the second operating parameter value 270, which is the updated reference data point. Thus, the deviation between the fourth operating parameter value 276 and the second operating parameter value 270 may be used to determine the refrigerant charge level of the HVAC system 150 at the fourth time. Further, in the illustrated diagram 260, the fourth operating parameter value 276 exceeds the high value 268 and therefore is outside of the tolerance range 264. Thus, the fourth operating parameter value 276 is determined to be indicative of an undesirable refrigerant charge level, rather than by the particular implementation of the HVAC system 150. As a result, a third indication may be output during the fourth time to indicate that the refrigerant charge level is undesirable and/or the operation of the HVAC system 150 may be suspended or shut down.

Embodiments of the present disclosure are directed to a system for monitoring a refrigerant charge level of an HVAC system. In some embodiments, the system may include a controller configured to receive respective sensor feedback from sensors configured to determine a respective operating parameter. During the normal operation mode of the HVAC system, the controller may use the sensor feedback to compare the operating parameter values with a respective reference data point. Based on the comparison between the operating parameter values and the reference data points, the controller may determine the refrigerant charge level of the HVAC system. As an example, the controller may determine the refrigerant charge level based on a deviation between a particular operating parameter and the corresponding reference data point. Further, the controller may be configured to update the reference data point to enable more accurate determination of the refrigerant charge level. For instance, during the normal operation mode of the HVAC system, the controller may receive multiple values of a particular operating parameter. The multiple values may each be substantially equal to a steady state value that is different than the reference data point to which the operating parameter is initially compared. Thus, the controller may determine the reference data point is to be changed to the steady state value, which may more accurately reflect a reference data point associated with an expected refrigerant charge level for the particular implementation of the HVAC system. As a result, subsequently received values of the operating parameter may be compared with the updated reference data point to determine the refrigerant charge level of the HVAC system more accurately. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a sensor configured to detect an operating parameter of the HVAC system;

a processor; and a memory including instructions executable by the processor to cause the processor, during a normal operation mode of the HVAC system, to iteratively:

receive feedback from the sensor indicative of a value of the operating parameter;

compare the value with a reference data point;

determine a refrigerant charge level of the HVAC system based on the value and the reference data point; and update the reference data point to an updated reference data point based on comparing the value with the reference data point.

2. The HVAC system of claim 1, wherein the operating parameter includes a discharge pressure of a compressor of the HVAC system, a discharge temperature of the compressor, a suction pressure of the compressor, a suction temperature of the compressor, a liquid pressure of refrigerant circulating through the HVAC system, a liquid temperature of refrigerant circulating through the HVAC system, an evaporating pressure of refrigerant in an evaporator of the HVAC system, an evaporating temperature of refrigerant in the evaporator, an evaporating pressure of refrigerant in a condenser of the HVAC system, an evaporating temperature of refrigerant in the condenser, a power consumption of the HVAC system, a rotation of a motor of the compressor, an operation of a fan of the HVAC system, an air flow rate through the HVAC system, a humidity of a space conditioned by the HVAC system, a temperature of the space conditioned by the HVAC system, an ambient temperature, or any combination thereof.

3. The HVAC system of claim 1, wherein the sensor is a component of an HVAC unit, and the memory and the processor are components of a controller of the HVAC unit.

4. The HVAC system of claim 1, wherein the sensor is a component of an HVAC unit, and the memory and the processor are components of a cloud-based system.

5. The HVAC system of claim 4, comprising a controller of the HVAC unit, wherein the controller is configured to transmit the feedback from the sensor to the processor.

6. The HVAC system of claim 5, wherein the controller is a thermostat.

7. The HVAC system of claim 1, wherein the instructions are executable by the processor to cause the processor to output a notification in response to a determination that the value of the operating parameter deviates from the reference data point, and the notification is indicative that the refrigerant charge level of the HVAC system is different than an expected refrigerant charge level of the HVAC system.

8. The HVAC system of claim 1, wherein the processor is configured to execute the instructions upon startup of the HVAC system in the normal operation mode, once per minute during the normal operation mode, or both.

9. A non-transitory computer readable storage medium for a heating, ventilation, and/or air conditioning (HVAC) system comprising instructions that, when executed by a processor, are configured to cause the processor, during a normal operation mode of the HVAC system, to:

receive an input indicative of an operating parameter value of the HVAC system from a sensor of the HVAC system for a plurality of iterations;

correlate the operating parameter value to a reference data point determined in testing of the HVAC system;

compare the operating parameter value to the reference data point for the plurality of iterations;

determine a refrigerant charge level of the HVAC system based on correlation of the operating parameter value and the reference data point for the plurality of iterations; and update the reference data point to an updated reference data point based on comparison of the operating parameter value to the reference data point in the plurality of iterations.

10. The non-transitory computer readable storage medium of claim 9, wherein the updated reference data point is within a tolerance range determined in testing of the HVAC system.

11. The non-transitory computer readable storage medium of claim 9, wherein the operating parameter value indicated by the input received in the plurality of iterations is a steady state value, and a value of the updated reference data point is equal to the steady state value.

12. The non-transitory computer readable storage medium of claim 9, wherein the non-transitory computer readable storage medium is a component of an onboard controller of the HVAC system.

13. The non-transitory computer readable storage medium of claim 9, wherein the non-transitory computer readable storage medium is a component of a cloud-based system.

14. The non-transitory computer readable storage medium of claim 9, wherein the instructions, when executed by the processor, are configured to cause the processor to:

determine that the refrigerant charge level of the HVAC system is an expected refrigerant charge level in response to a determination that the operating parameter value is substantially the same as the reference data point; and determine that the refrigerant charge level of the HVAC system deviates from the expected refrigerant charge level in response to a determination that the operating parameter value is substantially different than the reference data point.

15. The non-transitory computer readable storage medium of claim 14, wherein the instructions, when executed by the processor, are configured to cause the processor to output an indication in response to a determination that the refrigerant charge level of the HVAC system deviates from the expected refrigerant charge level.

16. A heating, ventilation, and/or air conditioning (HVAC) system, comprising:

a plurality of sensors, wherein each sensor of the plurality of sensors is configured to detect a respective operating parameter of a plurality of operating parameters of the HVAC system; and a controller configured to, during a normal operation mode of the HVAC system, iteratively:

receive feedback from the plurality of sensors, wherein the feedback includes a respective value associated with each operating parameter of the plurality of operating parameters of the HVAC system;

compare each value with respective reference data;

determine that first feedback from a first sensor of the plurality of sensors is indicative of a first deviation of a value of a particular operating parameter from a corresponding reference data point;

determine whether the first deviation is caused by a second deviation of a current refrigerant charge level from an expected refrigerant charge level based on second feedback from a second sensor of the plurality of sensors; and determine the current refrigerant charge level of the HVAC system based on the first deviation in response to a determination that the first deviation is caused by the second deviation.

17. The HVAC system of claim 16, wherein the controller is configured to:

determine whether the value associated with the particular operating parameter of the first feedback received from the first sensor of the plurality of sensors is within a tolerance range in response to the determination that the first deviation is caused by the second deviation, wherein the tolerance range is established during testing of the HVAC system; and output an indication that the current refrigerant charge level deviates significantly from the expected refrigerant charge level in response to a determination that the value associated with the particular operating parameter is outside of the tolerance range.

18. The HVAC system of claim 16, wherein the controller is configured to:

determine whether the value associated with the particular operating parameter of the first feedback received from the first sensor of the plurality of sensors is within a tolerance range in response to the determination that the first deviation is caused by the second deviation, wherein the tolerance range is established during testing of the HVAC system;

determine whether the value associated with the particular operating parameter of the first feedback received from the first sensor of the plurality of sensors is a steady state value; and update the corresponding reference data point for the particular operating parameter to be equal to the steady state value in response to a determination that the value associated with the particular operating parameter is the steady state value.

19. The HVAC system of claim 18, wherein the controller is configured to receive the first feedback including the value associated with the particular operating parameter for a plurality of iterations and determine whether the value associated with the particular operating parameter is the steady state value based on whether the value is substantially constant for the plurality of iterations.

20. The HVAC system of claim 18, wherein the controller is configured to:

receive third feedback from the first sensor after the corresponding reference data point is updated to be equal to the steady state value, wherein the third feedback includes an additional value associated with the particular operating parameter;

compare the additional value with the corresponding reference data point; and determine a subsequent refrigerant charge level of the HVAC system based on comparison of the additional value with the corresponding reference data point.

21. The HVAC system of claim 16, wherein the controller is communicatively coupled to a database, the controller is configured to compare each value with the respective reference data using information from the database, and the information includes a database table, an algorithm, a model, or any combination thereof.

22. The HVAC system of claim 16, comprising a refrigerant circuit, wherein the current refrigerant charge level of the HVAC system is associated with a total volume of refrigerant circulating through the refrigerant circuit.

* * * * *